US005592794A

United States Patent [19]

Tundaun

[11] Patent Number: 5,592,794

[45] Date of Patent: Jan. 14, 1997

[54] INTERLOCKING OFFICE PANEL DEVICE

[76] Inventor: Apisit Tundaun, 10002/2 Soi Saenanikom 1, Pholyothin Rd, Bangkok, 10900, Thailand

[21] Appl. No.: 507,588

[22] Filed: Jul. 26, 1995

[51] Int. Cl.[6] ..... E04B 2/28

[52] U.S. Cl. ..... 52/220.7; 52/281; 52/582.1; 52/586.1

[58] Field of Search ..... 52/220.7, 584.1, 52/582.1, 586.1, 281, 282.1

[56] References Cited

U.S. PATENT DOCUMENTS

| | | | |
|---|---|---|---|
| 3,267,631 | 8/1966 | Hammitt | 52/584.1 X |
| 3,512,819 | 5/1970 | Morgan et al. | 52/586.1 X |
| 3,570,205 | 3/1971 | Payne | 52/586.1 X |
| 4,435,935 | 3/1984 | Larrea | 52/582.1 X |
| 4,712,352 | 12/1987 | Low | 52/582.1 X |
| 4,936,069 | 6/1990 | Hunter et al. | 52/586.1 X |
| 4,953,333 | 9/1990 | Carlson | 52/281 |
| 5,007,222 | 4/1991 | Raymond | 52/586.1 |
| 5,058,347 | 10/1991 | Schuelke et al. | 52/281 X |
| 5,325,649 | 7/1994 | Kajiwara | 52/586.1 |

FOREIGN PATENT DOCUMENTS

| | | | |
|---|---|---|---|
| 1013451 | 12/1965 | United Kingdom | 52/281 |

*Primary Examiner*—Wynn E. Wood
*Attorney, Agent, or Firm*—Richard P. Stitt

[57] ABSTRACT

A device for interlocking office divider panels is provided which permits the connection of office divider panels while providing for a cable duct between panels and the mounting of office accessories at any height of the panel and while permitting the assembly of panels without the need to lift office panels and while permitting the removal of a single panel without disturbing the adjoining office divider panels.

8 Claims, 2 Drawing Sheets

INTERLOCKING OFFICE PANEL DEVICE

BACKGROUND OF THE INVENTION

This invention relates to divider systems for use in offices, and specifically to a partition interconnection device which is used with office divider partitions.

In the field of office furniture it is common for large amounts of office space to be subdivided into cubicles by the use of divider panels which can be interconnected in a multitude of combinations in order to subdivide a large office space into individual, door-less offices.

Typically, such divider panels are approximately six feet high and are not only utilized for subdividing the office space, but also for providing channels for holding electrical wiring, telephone wires and computer cables. In addition to providing thoroughfares for cabling, office panels also must provide means for supporting shelves and bookcases and attachments of modular office furniture such as desks and other cabinetry. Further, office partition devices must be structurally stable and securely interconnect in order to avoid wobbling after being assembled.

In the usual office circumstance, the assembled divider panels are viewed as structurally sound walls by the typical office user and, therefore, the connected panels must be capable of withstanding the jolt of office personnel leaning against the panels and bumping against the panels and generally utilizing the divider panel wall as they would a permanent wall structure.

As office divider panels are intended to be temporary structures which may be disassembled and reconfigured on demand of the user, it is important that the interconnection between office panels be easily assembled and disassembled while providing a strong secure connection between panels. An additional desirable feature of such office panels is that the means for connecting the panels be concealed so that the means for fastening the panels together does not detract from the overall appearance of the partition system. Further, it is important that the means for connection be flush with the panel surfaces so that fastener protrusions do not exist to catch clothing of personnel as they pass by the panels.

It is another important requirement of office partition interconnection devices that they provide a means for connection of the office furniture and accessories which is easily accessible and yet can be concealed when not in use. In addition, it is necessary that the means for attachment of office accessories such as cabinetry, desks, and shelves provide strong, secure attachment and support of the accessories. In addition, it is important that the means for attaching accessories allow the positioning of the accessories at any selected height between the top of the partition and the bottom.

It is a further requirement of such office partition systems that the means for connecting panels together avoid interference with the channels provided for running of cables as well as avoiding interference with the means provided for attachment of accessories. Y Yet another consideration in the design of such office divider panels is that the means for connecting office panels or for connecting accessories does not require the panel assembler to lift a panel in order to engage a first panel with a second panel during the interconnection. As office partition panels are generally reasonably heavy items, it is not only difficult to lift the panels, but it is also difficult to guide such weighty items into connecting slots affixed to an adjoining panel.

Another feature of importance in office panel connection devices is that the means for interconnecting panels permit the insertion or removal of a single panel from a row of panels without requiring disassembly or manipulation of adjoining panels which previously have been implaced and which may have substantial amounts of office furniture and accessories attached thereto.

SUMMARY OF THE INVENTION

The invention provides for a means of interconnection of office partition panels which permits the joining of office panels by abutting the ends of the panels and then sliding the panels laterally to interlock the abutted ends of the panels. A securing means in the form of a set screw is then tightened to fix the interconnected panels in place. The interconnection between panels is made such that a vertical channel is provided for passage of cables vertically between two interconnected panels while also providing a channel for attachment of accessories and components at any height along the panel.

Therefore, it is an object of the present invention to provide a means for interconnection of office partitions which avoids the need to lift entire panels in order to engage and connect a first panel with the second panel.

Another object of the present invention is to permit interconnection of office partition panels while providing a vertical cable channel between two adjoining panels.

Yet another object of the present invention is to provide a means for interconnection of two partitions or office divider panels which provides a means for attachment of office accessories and components at any height along the point of interconnection between two adjacent panels.

Another object of the present invention is to provide a sturdy, easily assembled interconnection between office panels which is stable and secure and resists flexing of the joint between two abutting office partition panels.

Yet another object of the present invention is to allow the removal of an office partition panel from its connection with the panels at either end without disturbing the panels adjoining the one to be removed.

The foregoing and other objects are not meant in a limiting sense, and will be readily evident upon a study of the following specification and accompanying drawings comprising a part thereof.

DETAILED DESCRIPTION OF THE PREFERRED EMBODIMENTS

Figure 1:
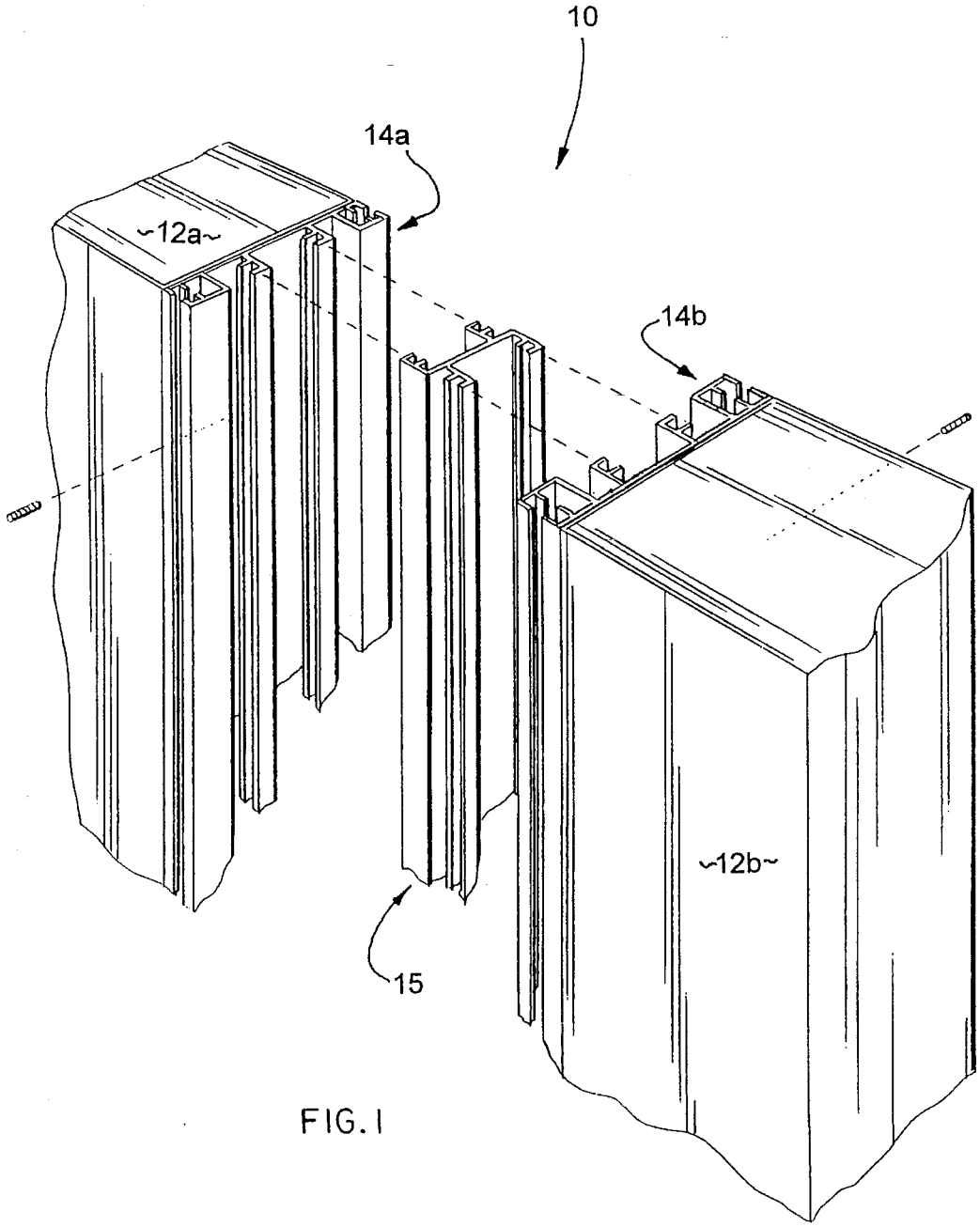
FIG. 1 is a from and right side exploded perspective fragmentary view of the inventive office panel interconnect device attached to two adjacent partition panels.

Referring now to FIG. 1, an embodiment of the present invention 10 is shown in exploded view. In general, the invention is comprised of panel end plates 14*a*, 14*b*, which are affixed to office-type partition panels 12*a*, 12*b*. Partition panels 12*a*, 12*b* are then secured together by the interconnection of panel end plates 14*a*, 14*b* with connection shoe 15.

When it is desired to interconnect office panels, panel end plate 14*a*, 14*b* is attached to the entire vertical length of the facing ends of the selected panels. Panel end plates 14*a*, 14*b* may be attached by fasteners to the office divider panels or may be manufactured concurrently with each panel. After the attachment of panel end plate 14*a*, 14*b*, connection shoe 15 is interposed between panel end plate 14*a* and panel end plate 14*b* and is utilized to interconnect the panels 12*a*, 12*b*.

Figure 2:
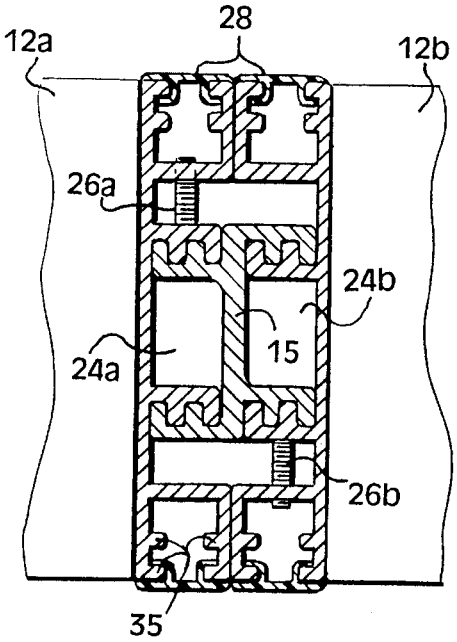
FIG. 2 is a top plan view of an assembled panel interconnect device joining two end abutting office partition panels.

Referring now to FIG. 2, the resulting interconnection of divider panels 12*a* and 12*b* by an embodiment of the present invention is shown. It may be seen in FIG. 2 that a tight, complete and structurally sound connection between panels 12*a* and 12*b* is provided by the present invention. Also shown in FIG. 2 is cable duct 24*a*, 24*b* which is provided by the present invention for passage of electrical wiring and computer cables and the like, upwardly or downwardly between panels 12*a*, 12*b*. Once panels 12*a* and 12*b* are interconnected by connection shoe 15 engaging end plates 14*a*, 14*b*, a securing means is utilized to secure the components together and prevent separation of panels 12*a*, 12*b*. In the present embodiment, set screws 26*a*, 26*b* are tightened against interlocking flanges 33, 42 (FIGS. 2&3) of panel end plates 14*a*, 14*b* and connection shoe 15.

Figure 3:
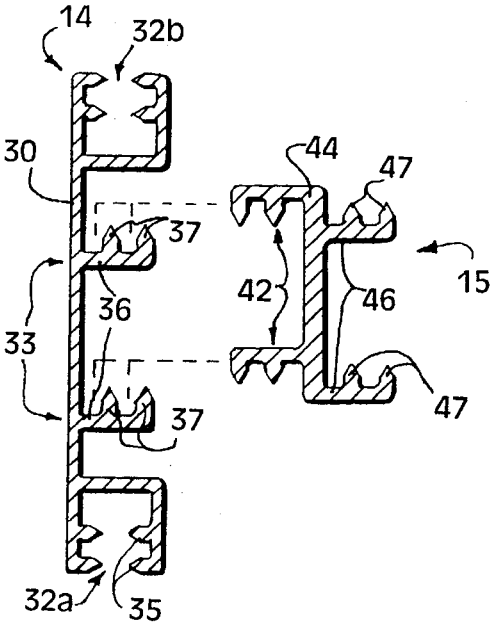
FIG. 3 is a top plan view of the panel end plate for attachment to an office partition panel with the connection shoe aligned for attachment thereto.

Referring now to FIG. 3, the components of end plates 14 ( 14*a*, 14*b* of FIG. 1 ) will be further described. Panel end plate 14 is comprised of base plate 30 which extends along the entire face of the end of an office partition panel. Base plate 30 may be constructed with a panel, if desired, or may be attached to an existing panel through the use of conventional fasteners such as screws, bolts or glue. At either edge of base plate 30 are accessory connection channels 32*a*, 32*b*.

Accessory connection channels 32*a*, 32*b* permit attachment of office accessories to the panels at any vertical height. An accessory bracket adapted for insertion into channels 32*a*, 32*b* (not shown) may be introduced into accessory channel 32*a*, 32*b* and fixed in place to permit the attachment of office components thereto or, alternatively, office accessories having mounting brackets which are compatible with accessory channels 32*a*, 32*b* can be used. In either case, when the accessory bracket is positioned at the selected height within accessory channel 32*a*, 32*b* it is fixed in place utilizing a fastener such as set screws 26*a*, 26*b* which secure the panels with connection shoe 15. The fastener provides compression capture of the bracket in channel 32*a*, 32*b*.

When accessory channel 32*a*, 32*b* is not being used for the connection of office components, it may be concealed by placing a covering over the channel. Referring again to FIG. 2, such a covering may be seen in the form of channel cover 28. Channel cover 28 may be made of any suitable pliable material such as plastic. Channel cover 28 is press fitted into accessory channel 32*a*, 32*b*. Cover 28 may be in the form of a T or may have individual legs as shown in FIG. 2 which are captured by bead 35 of accessory channel 32*a*, 32*b*.

Referring to FIGS. 3 the means for interconnection of panel end plate 14*a*, 14*b* with connection shoe 15 will be discussed. Panel end plate connection flanges 33 extend from base plate 30 of panel end plate 14 and are slightly laterally spaced from the center longitudinal axis of end plate 14*a*, 14*b*. Flanges 33 are comprised of legs 36 and arms 37. Arms 37 are registerably engageable with arms 47 of similarly shaped flanges 42 which extend from either side of shoe 15. Flanges 42 of shoe 15 are also comprised of legs 46 and arms 47.

Legs 36 of flanges 33 and legs 46 of shoes flanges 42 are spaced outwardly from panel end plate 14*a*, 14*b* and shoe spine 44 in order to provide cable duct void 24 (FIG. 2) when end plate flanges 33, are connected with flanges 42 of shoe 15. Referring now to FIG. 3, it may be seen that connection shoe 15 is provided with flanges 42 which are similarly shaped to those of panel end plate flanges 33 for registerable connection therewith. Shoe flanges 42 are spaced outwardly from shoe spine 44 in order to create cable duct void 24*a*, 24*b* which exists between base plate 30 of panel end plate 14*a*, 14*b* and shoe spine 44 of connection shoe 15 when shoe 15 and end plates 14*a*, 14*b* are interconnected.

Still referring to FIG. 3, it may be seen that connection shoe 15 is provided with flanges 42 on either side of shoe spine 44. However, flanges 42 of either side are offset with respect to flanges 42 of the opposing side so that as shoe 15 is interconnected with panel end plate 14*a*, 14*b* (FIG. 2), alignment of the outside edges of panel end plates 14*a*, 14*b* occurs and the outside surface of the panels are aligned and flush with one another.

The offset configuration of flanges 42 of connection shoe 15 permits engagement of flanges 33 on panel end plate 14 when panel end plate 14 approaches connection shoe 15 from either the right or left hand side. This allows manufacture of a single configuration of panel end plate 14*a*, 14*b* for use with connection shoe 15.

Figure 4:
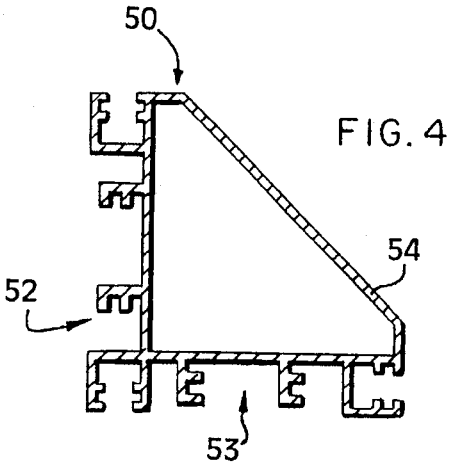
FIG. 4 is a top plan view of an alternative embodiment of the panel end plate of FIG. 3 in which two panel end plates are joined orthogonally to permit the right angle connection of two office divider panels having panel end plates mounted thereon.

Referring now to FIG. 4, an alternative embodiment of panel end plate 14 (FIG. 3), is shown wherein two panel end plates 52, 53 have been joined at a right angle to one another in order to create a panel end plate 50 for use in connecting two office partition panels at a right angle to one another. Right angle end plate 50, while being of unitary construction, is essentially two panel end plates 14, as shown individually in FIG. 3, which have been joined at a right angle to one another and having additional support bridging the hypotenuse in the form of back plate 54. Right angle end plate 50 is used in situations in which two office panels are joined to form a comer of a right angle.

Figure 5:
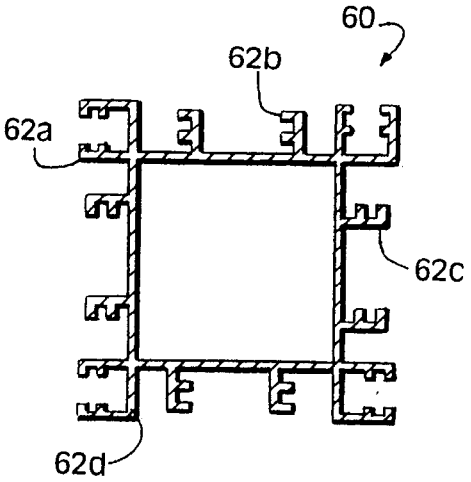
FIG. 5 is a top plan view of an alternative arrangement of the panel end plates of FIG. 3 in order to permit the connection of four office panels having panel end plates thereon about a single point.
Figure 2:
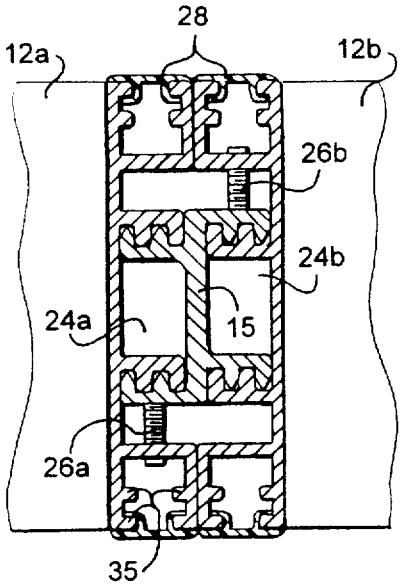
Figure 3:
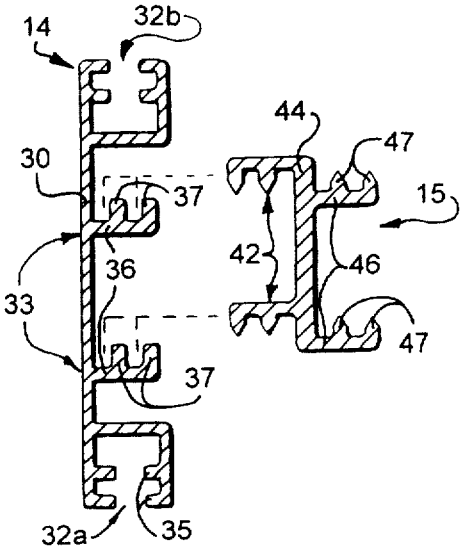
Figure 4:
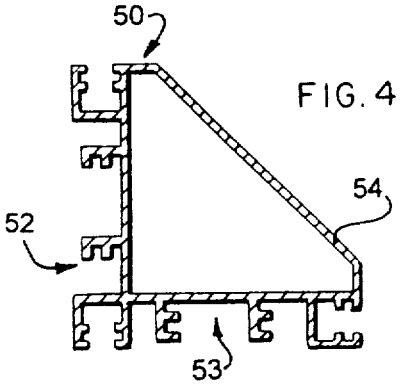
Figure 5:
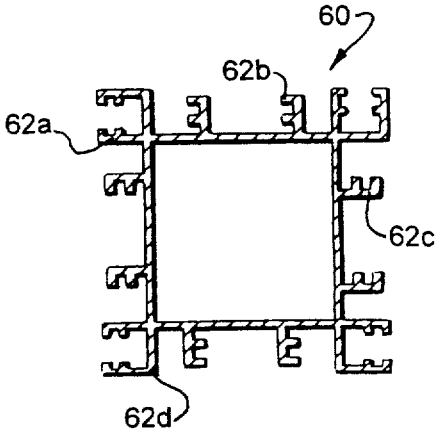

Referring now to FIG. 5, an alternative embodiment of panel end plate 14*a*, 14*b* (FIG. 1) is shown. Center post plate 60 is a configuration of multiple end plates 14 as shown in FIG. 3 and may be used for the connection of three office partition panels into a "T" shape or for the interconnection of four office panel partitions all at right angles to their adjacent office panel partitions. The embodiment shown in FIG. 5 is of unitary construction for ease of manufacture, however, it will be appreciated by those skilled in the art, that right angle connecting rods could be used to connect four of the single end plates 14 shown in FIG. 3 to achieve the same functional considerations as the unitary device of FIG. 5.

In use center post plate 60 is attached to a panel end plate 14*a* or 14*b* (FIG. 1) at position 62*a*–*d* of center post plate 60 in the manner previously described for the abutting panel end plates 14*a*, 14*b* of FIG. 2. Afterward, with center post plate 60 supported by a first office partition panel, other office partition panels may be attached as desired at the remaining available positions 62*a*–62*d* of post plate 60.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

It is also to be understood that the following claims are intended to cover all of the generic and specific features of the invention herein described, and all statements of the scope of the invention which, as a matter of language, might be said to fall therebetween Particularly, it is to be understood that in the claims, ingredients or compounds recited are intended to include compatible mixtures of such ingredients.

What is claimed as new and desired to be secured by Letters Patent is as follows:

1. A room subdividing device comprising:

a panel for use as a partial wall to subdivide room space, said panel having two vertical ends connected by sidewalls, a base plate for attachment to said panel end, said plate having a flange extending generally orthogonally therefrom, said flange presenting an arm extending therefrom and generally parallel to said base plate, a shoe comprising a center spine having a first and second face, said spine having a plurality of flanges extending orthogonally from either face of said spine, said shoe flanges presenting an arm extending therefrom, said arm of said shoe flanges being engageable with said arm of said base plate flanges for capture of said panel-attached base plate with said shoe, said base plate flange and said shoe flange being sufficiently long so as to space said base plate from said shoe spine to provide a void for insertion of a cable therethrough, and a means for securing said shoe to said base plate upon engagement of said shoe flange with said base plate flange, such that said shoe flange of said first spine face is secured to a first panel base plate and said shoe flange of said second spine face is secured to a second panel base plate to interconnect said first panel with said second panel.

2. The device as claimed in claim 1 wherein said base plate further comprises a means for attaching office accessories thereto.

3. The device as claimed in claim 2 wherein said means for attaching office accessories comprises a rectangular channel extending along an outer edge of said base plate, said channel being adapted to receive a support extending from said accessory said support having a means for fixing said support within said channel.

4. The device as claimed in claim 3 further comprising a cover for insertion within said channel to close said channel portion that is free of said support.

5. A connector for use with room subdividing panels for forming the panels into walls within said room, the panels having vertical ends connected by sidewall portions to define a panel top and panel bottom, said connector comprising:

a base plate for attachment to the panel end, said plate having a flange extending generally orthogonally therefrom, said flange presenting an arm extending therefrom and generally parallel to said base plate, a shoe comprising a center spine having a first and second face, said spine having a plurality of flanges extending orthogonally from either face of said spine, said shoe flanges presenting an arm extending therefrom, said arm of said shoe flanges being engageable with said arm of said base plate flanges for capture of said panel-attached base plate with said shoe, said base plate flange and said shoe flange being sufficiently long so as to space said base plate from said shoe spine to provide a void for insertion of a cable therethrough, and a means for securing said shoe to said base plate upon engagement of said shoe flange with said base plate flange, such that said shoe flange of said first spine face is secured to a first panel base plate and said shoe flange of said second spine face is secured to a second panel base plate to interconnect said first panel with said second panel.

6. The device as claimed in claim 5 wherein said base plate further comprises a means for attaching office accessories thereto.

7. The device as claimed in claim 6 wherein said means for attaching office accessories comprises a rectangular channel extending along an outer edge of said base plate, said channel being adapted to receive a support extending from said accessory said support having a means for fixing said support within said channel.

8. The device as claimed in claim 7 further comprising a cover for insertion within said channel to close said channel portion that is free of said support.

* * * * *

UNITED STATES PATENT AND TRADEMARK OFFICE

CERTIFICATE OF CORRECTION

PATENT NO. : 5,592,794

DATED : January 14, 1997

INVENTOR(S) : Apisit Tundaun

It is certified that error appears in the above-indentified patent and that said Letters Patent is hereby corrected as shown below:

Delete FIG.2 and substitute the attached FIG.2 therefore.

Delete FIG.3 and substitute the attached FIG.3 therefore.

Signed and Sealed this

Third Day of June, 1997

*Attest:*

*Attesting Officer*

Bruce Lehman

BRUCE LEHMAN

*Commissioner of Patents and Trademarks*